US005169028A

United States Patent [19]

Morrison

[11] Patent Number: 5,169,028

[45] Date of Patent: Dec. 8, 1992

[54] PHATORESIST DISPENSING SYSTEM

[75] Inventor: Pedro R. Morrison, San Antonio, Tex.

[73] Assignee: Advanced Micro Devices, Inc., Santa Clara, Calif.

[21] Appl. No.: 720,348

[22] Filed: Jun. 25, 1991

[51] Int. Cl.[5] ..... B67B 7/00

[52] U.S. Cl. ..... 222/1; 222/25; 222/145; 222/155; 604/260

[58] Field of Search ..... 222/1, 64, 185, 181, 222/145, 155, 25; 604/80, 81, 118, 260

[56] References Cited

U.S. PATENT DOCUMENTS

| | | | |
|---|---|---|---|
| 2,689,463 | 9/1954 | Arf | 222/64 X |
| 2,757,823 | 8/1956 | Blanchard et al. | 222/155 |
| 3,469,574 | 9/1969 | Durkan | 222/64 X |
| 3,677,248 | 7/1972 | McPhee | 604/81 X |
| 3,756,237 | 9/1973 | Chittenden et al. | 604/80 |
| 3,965,895 | 6/1976 | Dabney | 604/260 X |
| 4,157,717 | 6/1979 | Goldberg | 604/260 X |
| 4,324,238 | 4/1982 | Genese et al. | 604/81 |
| 4,946,439 | 8/1990 | Eggers | 604/81 X |

*Primary Examiner*—Gregory L. Huson
*Attorney, Agent, or Firm*—Skjerven, Morrill MacPherson, Franklin & Friel

[57] ABSTRACT

In a liquid dispensing system, two pouches containing a liquid to be dispensed are connected by tubing to a reservoir and positioned at different levels above the reservoir. As the liquid is dispensed from the reservoir, the higher of the two positions is emptied and replaced with a filled pouch. The pouches are then reversed, with the new pouch in a lower position. When the other pouch is empty, it is replaced and the positions of the two pouches are again reversed. As a result, a continuous supply of liquid is dispensed from the reservoir. Any bubbles which are introduced into the system when the pouches are changed are automatically allowed to escape the system via a liquid level indicator line. A second level indicator provides an alarm or other signal should the liquid fall to the level of the reservoir.

3 Claims, 2 Drawing Sheets

PHATORESIST DISPENSING SYSTEM

FIELD OF THE INVENTION

This invention relates to liquid dispensing systems and in particular to liquid dispensing systems in environments where the liquid must be free of bubbles and contamination when it arrives at its destination.

BACKGROUND OF THE INVENTION

In many industrial processes it is necessary to dispense a liquid to a number of machines or other pieces of equipment with as few interruptions as possible and with no contamination or gas bubbles in the liquid when it reaches its destination. One such situation is a semiconductor wafer fabrication facility, where photoresist must be dispensed to spinning machines which deposit it on the wafers. Hospitals and laboratories are other facilities where a liquid dispensing system of this kind is needed.

Photoresist is available in bottles or in sealed pouches made of a flexible membrane. To dispense the photoresist from a bottle, an ordinary tube is inserted into the liquid, and it is pumped from the bottle to a number of spinning machines. Because contamination may collect near the bottom of the bottle, the end of the tube is normally maintained an inch or so from the bottom of the bottle to avoid contaminating the flow to the spinning machines. In reality, the bottles are frequently discarded with as much as one-third of their contents remaining. Thus, an appreciable amount of photoresist is wasted. Moreover, each time the bottles are changed the spinning machine must be shut down.

An alternative arrangement for dispensing photoresist uses a pouch made of a flexible membrane. The pouch is inverted, with its mouth facing downward, and its mouth is connected to tubing which leads to the spinning machine. As photoresist is pumped through the tubing the pouch collapses, thereby preventing the development of a vacuum in opposition to the pumping action. While this arrangement substantially eliminates the contamination problem, bubbles can still enter the liquid each time the pouch is changed. If this happens, the entire fluid line from the pouch to the spinning machine must be purged to remove the bubbles.

In a third system, a reservoir is connected to a vacuum pump and photoresist is drawn into the reservoir from two different sources. The photoresist collects in the bottom portion of the reservoir and from there is directed through a number of outlets and tubes to the spinning machines. Since the photoresist must fall some distance upon entering the reservoir, bubbles may form. When they do, a certain amount of photoresist must be drawn out through a bleed valve to remove the bubbles. Again, photoresist is wasted.

SUMMARY OF THE INVENTION

In an embodiment according to this invention, two pouches containing photoresist or another liquid to be dispensed are connected by separate tubes to a reservoir. The pouches are positioned above the reservoir at different heights. A system level indicator comprising a clear rigid tube extends upward from the top of the reservoir at least to the level of the pouches. When the pouches are connected to the reservoir, the liquid seeks a common level which is indicated by the level of the liquid in the indicator tube. A drain line and valve are connected to the bottom of the reservoir. Tubes for dispensing the liquid to the spinning machines or other equipment extend from the sides of the reservoir at a level below the input ports for the tubes which join the pouches with the reservoir. As the liquid is dispensed, the level of liquid in the system, as shown in the indicator tube, falls. When the liquid in the upper pouch has been depleted, the attendant disconnects that pouch, replaces it with a fresh pouch, and adjusts the positions of the pouches so that the new pouch is below the other pouch. When the second pouch is empty, the replacement process is repeated with that pouch. Any bubbles which enter the system as the pouches are being replaced rise up through the level indicator and escape to the atmosphere. No liquid is wasted in removing them. Since a filter caps the upper end of the indicator tube, contamination cannot easily enter the system. Any contaminants which do enter the system fall to the bottom of the reservoir where they can be removed through the drain valve. This process is necessary only infrequently and thus an insignificant amount of liquid is wasted in removing them.

A second level indicator monitors the level of the liquid if it should fall to the inside of the reservoir itself. When the liquid reaches a certain level, an indicator or alarm is triggered, notifying the attendant that the pouches need to be replaced. This system thus dispenses a virtually continuous supply of the liquid to the equipment, eliminating the necessity of shutting down the equipment when the pouches are replaced. Moreover, the quantity of liquid wasted is reduced to an absolute minimum.

The principles of this invention will be better understood by reference to the following detailed description, which incorporates the following drawings.

DESCRIPTION OF THE INVENTION

Figure 1:
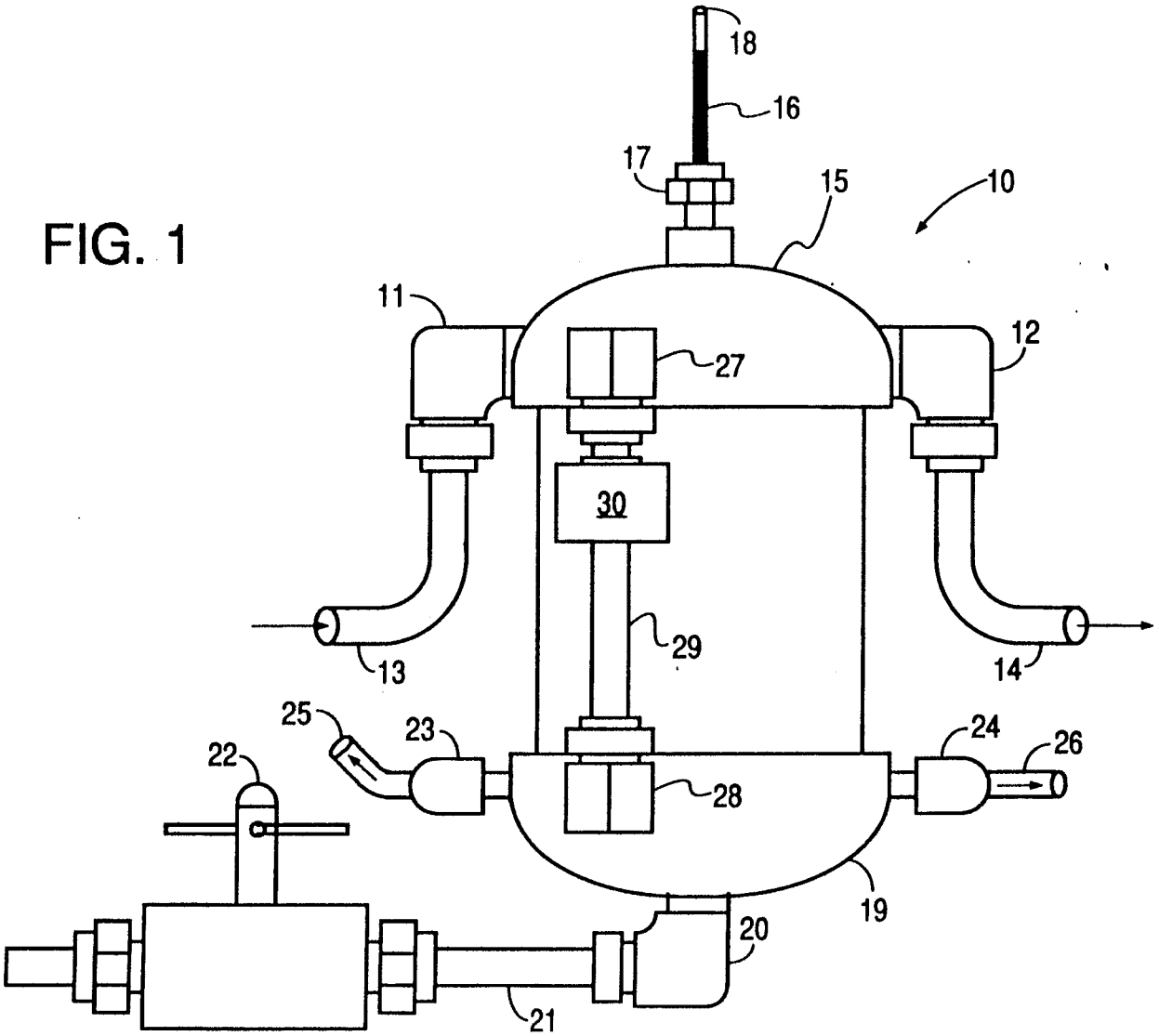
FIG. 1 illustrates a reservoir and associated elements in with the invention.

FIG. 1 illustrates a photoresist reservoir 10 with inflow fittings 11 and 12 which are connected to inflow tubes 13 and 14, respectively. Tubes 13 and 14 are connected to respective pouches which are not shown in FIG. 1. Reservoir 10 has a top cap 15 which is connected to a vertical level indicator tube 16 by means of a fitting 17. Level indicator tube 16 is made of a clear plastic or glass so that the level of a liquid in it is visible. A filter 18 caps the top of level indicator tube 16. In this embodiment filter 18 contains a membrane with 0.2 micrometer orifices.

A bottom cap 19 of reservoir 10 is connected through a fitting 20 and a drain line 21 to a drain valve 22. Outflow fittings 23 and 24 extend from the sides of bottom cap 19 and are connected to outflow tubes 25 and 26. Tubes 25 and 26 lead to respective pumps and to spinning machines which apply the photoresist to semiconductor wafers, none of which is shown in FIG. 1. Fittings 27 and 28 are attached to the sides of top cap 15 and bottom cap 19, respectively, and are connected by a clear tube 29, which extends through an optical sensor 30. Optical sensor 30, which is not shown in detail, includes a source of infrared light which is directed across tube 29 to an infrared detector. The detector receives infrared radiation only when the level of photoresist in tube 29 falls below the level of the infrared source and the detector. Optical sensor 30 is connected to a central control panel where the status of reservoir 10 is monitored. Optical sensor 30 is manufactured by Solametric, Inc. of Sunnyvale, Ca.

FIGS. 2A–2D illustrate the replacement sequence of the pouches used in conjunction with reservoir 10. Each figure shows pouches 40 and 41 connected by valves 42 and 43 to inflow tubes 13 and 14, respectively. In this embodiment, pouches 40 and 41 are suspended from a supporting structure (not shown) but they may be supported in a variety of ways.

Figures 2A, 2B, 2C, 2D:
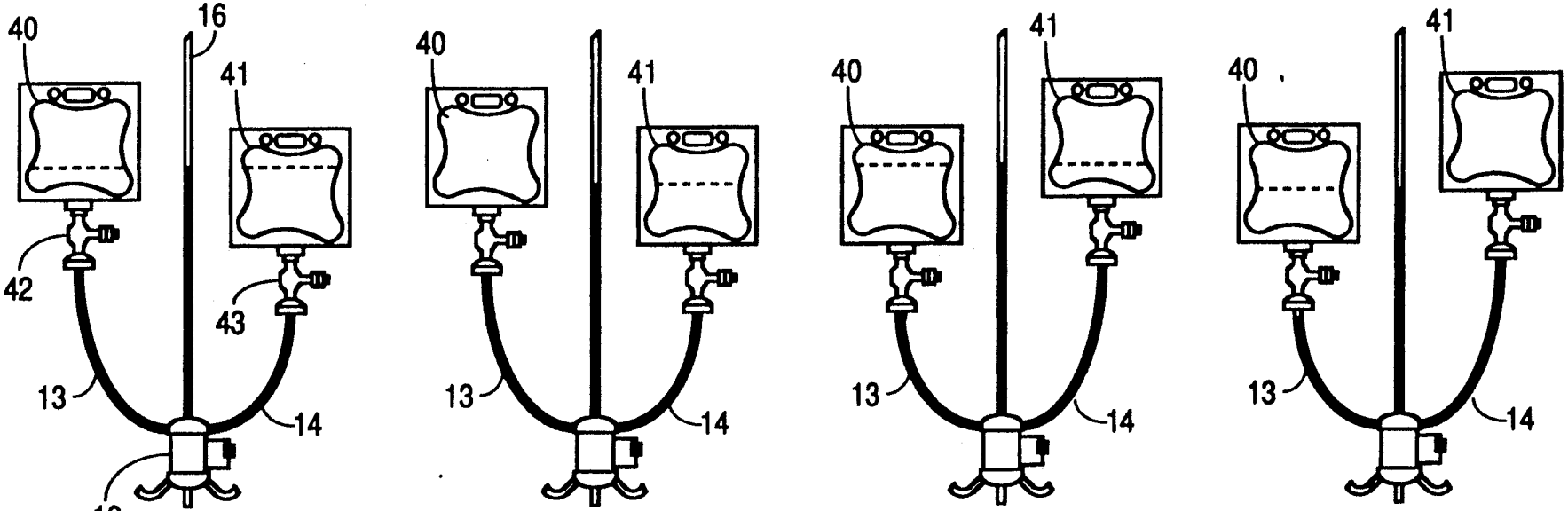
FIGS. 2A–2D illustrate the sequence of steps involved in replacing the pouches.

FIG. 2A illustrates the situation after new pouches 40 and 41 have been connected to reservoir 10 and valves 42 and 43 have been opened. The level of photoresist in pouches 40 and 41 is shown by the dotted lines and is also reflected by the level of photoresist in level indicator tube 16. Since pouch 40 is positioned above pouch 41, after the photoresist has filled reservoir 10 and the rest of the system pouch 40 is approximately one-third full. After the system has been operated for a short time, the situation is as shown in FIG. 2B. Pouch 40 is empty and pouch 41 is slightly less full than it was in FIG. 2A. At this point, existing pouch 40 is replaced with a new pouch 40 and the positions of the pouches with respect to reservoir 10 are reversed, so that pouch 41 is above pouch 40. This situation is shown in FIG. 2C. When pouch 41 is empty, as shown in FIG. 4D, it is replaced, and the positions of pouches 40 and 41 are again reversed. This results in an arrangement similar to that shown in FIG. 2A, and the entire process is then repeated.

While the uppermost pouch should be replaced when it is empty, there is some leeway in this regard. If the attendant defers replacing a pouch after it is empty, he or she will have to replace the second pouch after a shorter interval than would otherwise be necessary. If both pouches become empty, they may be replaced at the same time without interrupting the continuous operation of the spinning machines. In the worst case, if the photoresist level falls to reservoir 10, optical sensor 30 will finally generate a signal to the attendant indicating that the pouches need to be changed. Again, however, the operation of the spinning machines will not be disturbed, provided that the pouches are promptly replaced.

Should any bubbles be introduced to the system upon the changing of pouch 40 or pouch 41, they will flow through inflow tubes 13 or 14 to reservoir 10. Because top cap 15 slopes upward toward fitting 17, the bubbles will migrate into level indicator tube 16 where they will rise to the surface of the photoresist. If any contamination accumulates in reservoir 10, it can be removed by draining a small amount of the photoresist out through drain valve 22. The downward sloping surfaces of bottom cap 19 assure that any such contamination will collect in drain line 21.

The foregoing description is intended to be illustrative and not limiting. Many other embodiments will occur to those skilled in the art all of which are within the broad principles of this invention. For example, pouches 40 and 41 may be replaced by any type of liquid container which is capable of holding a liquid while allowing flow into tubes 13 and 14. Moreover, while the above embodiment is a system for dispensing photoresist to spinning machines in a semiconductor fabrication facility, the principles of this invention are applicable to any system for dispensing a liquid to one or more pieces of equipment.

I claim:

1. A method of dispensing photoresist using a dispensing unit which comprises a reservoir, first and second containers containing photoresist connected to said reservoir by a first flexible tube and a second flexible tube, respectively, and an outflow conduit from said reservoir to a piece of equipment, a first valve being connected to said first flexible tube, a second valve being connected to said second flexible tube, and a third valve being connected in said outflow conduit, said method comprising:

positioning said first and second containers above said reservoir;

positioning said first container at a level higher than said second container;

opening said first and second valves;

opening said third valve to allow photoresist to flow to said piece of equipment;

after said first container is substantially empty, replacing said first container with a third container containing photoresist;

positioning said second container at a level higher than said third container;

after said second container is substantially empty, replacing said second container with a fourth container containing photoresist; and positioning said third container at a level higher than said fourth container.

2. The method of claim 1 wherein said first, second, third and fourth containers comprise flexible pouches.

3. The method of claim 2 comprising the step of delivering said photoresist through said overflow conduit to a spin coating device for semiconductor wafers.

* * * * *

UNITED STATES PATENT AND TRADEMARK OFFICE

CERTIFICATE OF CORRECTION

PATENT NO. : 5,169,028

DATED : December 8, 1992

INVENTOR(S) : Pedro R. Morrison

It is certified that error appears in the above-identified patent and that said Letters Patent is hereby corrected as shown below:

On the title page: Item [54] and Column 1, line 1

In the title, delete "PHATORESIST DISPENSING SYSTEM" and substitute --PHOTORESIST DISPENSING SYSTEM--; and In the abstract, line 5, delete "positions" and substitute --pouches--.

Signed and Sealed this

Sixteenth Day of November, 1993

*Attest:*

Bruce Lehman

BRUCE LEHMAN

*Attesting Officer*

*Commissioner of Patents and Trademarks*